United States Patent [19]

Abrams

[11] 4,107,869

[45] Aug. 22, 1978

[54] DEMOUNTABLE TOY HOUSE

[75] Inventor: D. David Abrams, Kowloon, Hong Kong

[73] Assignee: Mego Corp., New York, N.Y.

[21] Appl. No.: 777,850

[22] Filed: Mar. 15, 1977

[51] Int. Cl.[2] ..... A63H 33/08

[52] U.S. Cl. ..... 46/21

[58] Field of Search ..... 46/19, 21

[56] References Cited

U.S. PATENT DOCUMENTS

| | | | |
|---|---|---|---|
| 1,241,594 | 10/1917 | Williams | 46/21 |
| 1,428,405 | 9/1922 | Wegener | 46/21 |
| 1,551,666 | 9/1925 | Jensen et al. | 46/21 |

*Primary Examiner*—F. Barry Shay
*Attorney, Agent, or Firm*—Bertram Frank

[57] ABSTRACT

A toy house, such as a toy country store, formed by a plurality of interlocking panels which do not rely on separate pins, clips or the like for attachment together. In one embodiment the toy house is formed, without exterior walls, of panels which interlock by means of slots. Another embodiment relies on plastic fittings to hold edges together, and in addition bendable joints between panel sections are provided. The panel members in any case have slits or slots and/or joining edges so that the panels fit together to yield a toy house such as a toy store, or other structures.

8 Claims, 26 Drawing Figures

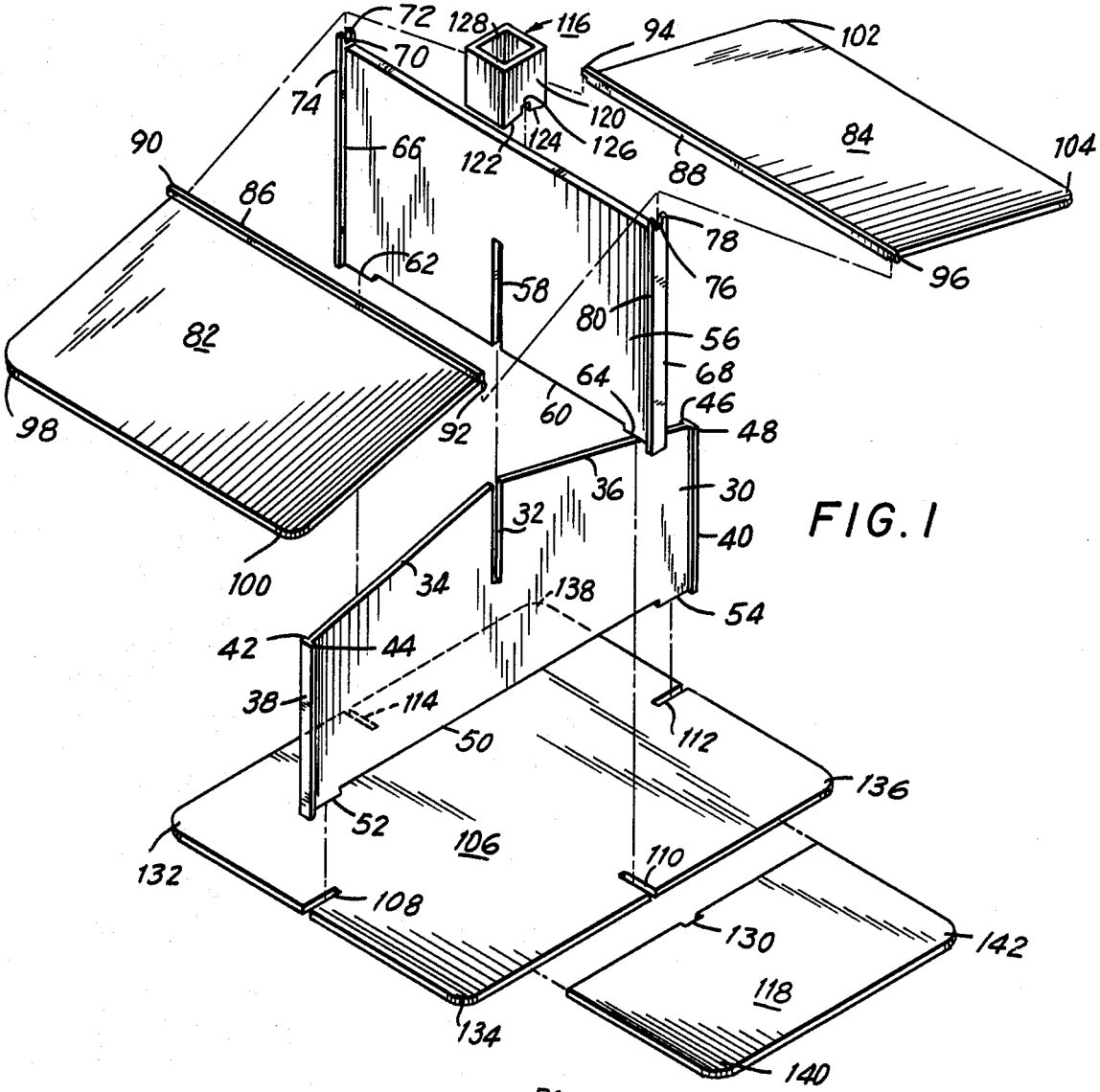
FIG. 1
FIG. 2
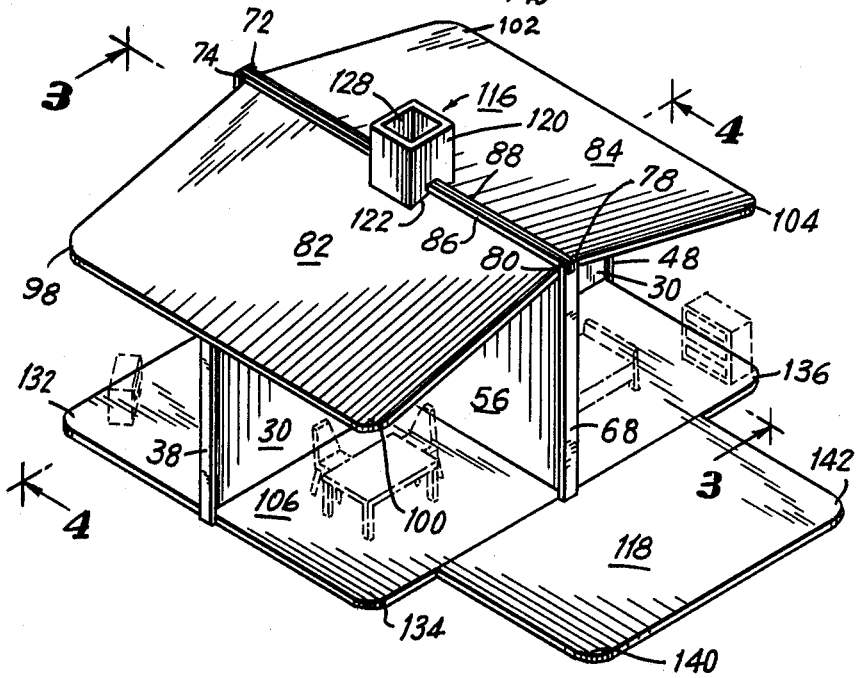

118
68
78
80
106
64
56
5
128
88
116
86
84
30
48
54
44
52
82
120
74
62

DEMOUNTABLE TOY HOUSE

BACKGROUND OF THE INVENTION

1. Field of the Invention

A toy house.

2. Description of the Prior Art

Toy houses provide much enjoyment for children, because of the simulation of ownership of real property and the stimulation of being in exclusive possession of territory, namely the interior of the toy house. This is especially true when small scale appurtenances such as toy furnishings and toy figures are also provided, to fit inside the toy house.

Among the abundance of recent prior art related to this field of art may be mentioned the following U.S. patents which relate to three-dimensional toy houses: U.S. Pat. Nos. 3,906,659; 3,888,039; 3,872,620; 3,849,930; 3,751,848; 3,729,881; 3,719,001; 3,629,969; 3,597,858; 3,548,552; 3,446,790 and 3,363,360. In general, the prior art relies on separate pins and/or clips or the like to hold the several panels of a toy house together and thus to provide a unitary structure.

SUMMARY OF THE INVENTION

1. Purposes of the Invention

It is an object of the present invention to provide an improved toy house.

Another object is to provide a toy house which may be assembled without the usage of separate pins, clips, bolts or the like.

A further object is to provide a toy house which is simply and easily assembled by a child.

An additional object is to provide a toy house which is of low cost to manufacture while providing the appearance of a real house.

Still another object is to provide a toy house which is rugged and durable when assembled, and which is not easily broken by a child at play.

These and other objects and advantages of the present invention will become evident from the description which follows.

2. Brief Description of the Invention

In the present invention, at least one vertically oriented interior panel is provided in the toy house. In addition, at least one inclined roof panel and a horizontal flat floor panel are provided. The floor panel is provided with integral means to provide restraint of the first panel so as to maintain it in an upright position. In addition, the roof panel is supported in an inclined position by means which are also restrained by the integral means in the floor panel.

In one embodiment of the invention, a pair of perpendicular vertical panels are provided in the interior of the toy house, which is assembled from a plurality of flat planar panels. A first vertical interior panel has an upper vertical slot, two upper edges which slope downwardly away from the open upper end of the slot, two vertical side edges, each of which is defined by a vertical strip having two lips which extended transversely to the side edges of the panel, and a lower horizontal edge having a terminal vertical extension at each end. A second vertical interior panel is provided. The second panel is oriented generally perpendicular to the first panel, and is a generally rectangular panel. The second panel is provided with a lower vertical slot which extends upwards from the lower horizontal edge of the second panel, so that each of the first and second panels fits into the respective slot of the other panel and thus the two panels are oriented in a disposition perpendicular to each other. The lower horizontal edge of the second panel is provided with terminal vertically downward extensions at each end thereof. The second panel also has two vertical side edges, each of which is defined by a vertical strip. Each vertical strip of the second panel has an upper recess and two lips which extend transversely to a side edge of the second panel. Two generally rectangular roof panels are also provided. Each roof panel is provided with a horizontal lip which extends transversely to the top edge of the panel. Each of these lips projects outwards from the corners of the panel, so that when the toy house is assembled, each lip extends into one of the aforementioned upper recesses in a vertical strip of the second panel. Finally, a fifth panel is provided as a floor panel of the toy house. This floor panel is a horizontally oriented generally rectangular panel, with a slot extending inwards from the periphery of each edge of the floor panel. When the toy house is assembled, each terminal vertically downward extension of the first and second panels extends into one of the slots in the floor panel. Thus the toy house is assembled into a rigid configuration without the use of bolts, pins or clips.

In preferred embodiments of this configuration of the invention, the toy house may be provided with a rectangular parallelepiped chimney. Two opposed lower edges of the chimney conform to the dimension of the toy house, i.e. each of two opposed lower edges of the chimney slope upwards from either end to a central notch. The central notches in the opposed lower edges of the chimney fit over the juxtaposed lips of the roof panels when the toy house is assembled. The outer corners of the roof panels and the corners of the floor panel will preferably be curved, i.e. rounded. Typically the toy house in this embodiment described supra is a wooden house, i.e. the panels are composed of wood, e.g. plywood. A rectangular horizontal panel simulating a patio may also be provided. One edge of this panel is provided with a notch, which notch fits over the lower end of an edge strip of the first or second panels when the toy house is assembled. The outer corners of the patio panel may be rounded. Finally, in a preferred embodiment, the several members are symmetrically oriented, i.e. the upper vertical slot of the first vertical panel and the lower vertical slot of the second vertical panel are each centrally located in the respective panel, and the slots in the floor panel are each located generally about at the center of the respective side edge of the floor panel.

In an alternative embodiment of the invention, at least one of the panels includes a flexible and resilient bendable connection between sections. Typically, in this embodiment, a first panel consisting of a vertically oriented interior panel is provided. A second panel which is horizontally oriented for assembly is also provided. The second panel includes a central floor section and at least one lateral section which is connected along one edge to the central floor section by a bendable flexible and resilient connection, so that the lateral section is capable of being elevated to form an upright wall section perpendicular to the central floor section. Connection means are provided along one side edge of the upright wall section, and mating connection means are provided along a vertical edge of the first panel, so that the first panel and the upright wall section of the second panel are connectable perpendicular to each other. One or more roof panels are provided, with a roof panel being mountable along one edge to the first panel and supportable along its opposite edge by a plurality of stanchions or the like. Each stanchion extends generally vertically, from attachment to the roof panel, to attachment to mounting means provided along an edge of the central floor section of the second panel.

In a preferred embodiment of this alternative embodiment, the second panel has two lateral sections on opposite sides of the central floor section. Each lateral section is convertible into an upright vertical wall section, perpendicular to the central horizontal floor section, through the provision of a bendable connection between each lateral section and the central floor section. A plurality of connection means are provided along both vertical edges of the first panel, each of which connection means is matable with connection means along one side edge of each of the upright wall sections, so that the first panel and each of the upright wall sections are perpendicularly connectable, with the upright wall sections being parallel and in registration when both upright wall sections are connected to the first panel. The matable connection means for perpendicular connection of the first panel and each of the upright wall sections will typically consist of a plurality of pins on one member, each of which is slidable into lock position in a corresponding recess in the other member.

The third or roof panel is preferably mounted along one edge to the first panel by providing a plurality of spaced apart tabs along the edge of the third panel, and a corresponding plurality of tab entry openings in the first panel. Usually and preferably, each stanchion is provided with an upper tab and a lower protuberance. The upper tabs fit into openings in the opposite edge of the third (roof) panel, and the lower protuberances fit into recesses along an edge of the central floor section of the second panel.

The lower edge of the first panel will usually be contiguous with the central floor section of the second panel when this alternative embodiment of the toy house is assembled, and the second panel preferably extends outwards on both sides of the contiguous junction with the first panel. The reason for this arrangement is so that one side of the assemblage may simulate the exterior, e.g. front porch, of the toy house; while the other side of the assemblage simulates the interior of the toy house. In this case, the first panel will usually be provided with an integral door or means simulating a door. Also, the third panel (roof) will be mounted above one side of the second panel, to simulate a front porch of the toy house, and the other side of the second panel will be provided with means simulating the interior of the toy house, such as a toy stove, toy furniture, etc., mounted on the central floor section of the second panel, and appropriate legends, illustrations and/or pictures will be provided on either side of the first panel and also on the upright wall sections of the second panel. Thus the panels will typically be composed of laminated cardboard having plastic edges and joining pieces, with the laminated cardboard panels being flat pieces of laminated paper, each panel being printed over legends and/or pictures, and each panel being covered on both sides with a thin plastic film composed of a plastic material such as polyethylene, polyvinyl chloride, mylar, cellulose acetate, cellulose acetate butyrate, nylon or an acrylic resin such as methyl methacrylate or lucite.

The toy house configuration of the present invention provides several salient advantages. The toy house is assembled without the usage of pins, clips, bolts or the like and thus small parts are not employed to hold the panels together. Therefore small parts such as pins or clips cannot become lost during handling or assembly, which loss could preclude proper assemblage of the toy house. The present toy house is simple in structural configuration and thus is easily assembled by a child. The toy house of the present invention is of low cost of manufacture while still providing the appearance and illusion of a real house, thus providing children with an inexpensive and attractive toy. The present toy house is rugged and durable when assembled, and is not easily broken by a child at play.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which are shown several of the various possible embodiments of the invention:

FIG. 1 is an exploded perspective view of one embodiment of the present toy house;

FIG. 2 is a perspective view of the assembled toy house of FIG. 1;

DETAILED DESCRIPTION OF THE PREFERRED EMBODIMENTS

Figures 3, 4, 5:
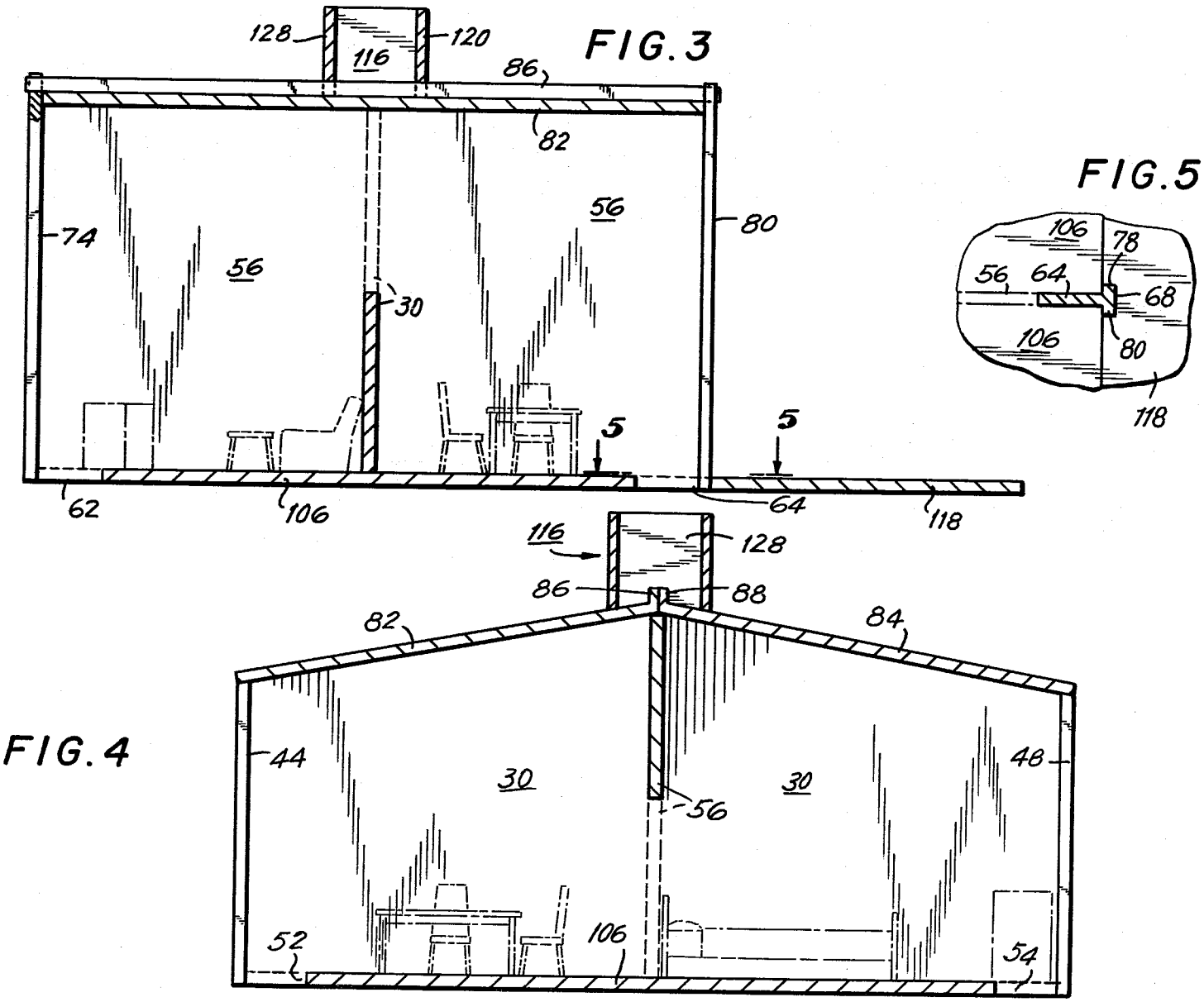
FIG. 3 is a sectional elevation view taken substantially along the line 3—3 of FIG. 2.
FIG. 4 is a sectional elevation view taken substantially along the line 4—4 of FIG. 2.
FIG. 5 is a partial sectional plan view taken substantially along the line 5—5 of FIG. 3.

Referring now to FIGS. 1–5 and especially to FIG. 1, the the several members of the toy house are shown separated from each other and will be described in detail. The toy house is characterized by the provision of a plurality of interconnected flat planar panels, as shown in FIG. 1. These panels include a first interior panel 30. The panel 30 is one of the two vertically oriented interior panels disposed at right angles, i.e. perpendicular to each other, in this embodiment of the invention. The panel 30 has an upper vertical slot 32, two upper edges 34, 36 which slope downwardly away from the open upper end of slot 32, and two vertical side edges defined by vertical strips 38, 40, each vertical strip having two lips which extend transversely to a side edge of the panel. Thus strip 38 includes lips 42, 44 and strip 40 includes lips 46, 48. The panel 30 is completed by the provision of a lower horizontal edge 50 having terminal vertical downward extensions 52, 54 at its end.

A second vertically oriented interior panel 56 is disposed at a right angle to the panel 30, i.e. the panels 30 and 56 are perpendicular to each other when the toy house is assembled. The panel 56 is a generally rectangular panel having a lower vertical slot 58, which slot 58 extends upwards from the lower horizontal edge 60 of the panel 56. Thus when the toy house is assembled, the panels 30 and 56 are generally perpendicular to each other, with the upper central portion of panel 56 fitting into slot 32 and the lower central portion of panel 30 fitting into slot 58. The lower edge 60 of the panel 56 has terminal vertical downward extensions 62 and 64 at its ends. The two vertical side edges of panel 56 are each defined by a vertical strip 66, 68. The vertical strip 66 has an upper recess 70 and two lips 72, 74 which extend transversely to the side edge of the panel 56. Similarly, the vertical strip 68 has an upper recess 76 and two lips 78, 80 which extend transversely to the opposite side edge of the panel 56.

The toy house is also provided with a third and fourth panels consisting of generally rectangular roof panels 82 and 84. The roof panel 82 has a horizontal lip 86 which extends transversely to the top edge of panel 82, and roof panel 84 has a similar horizontal lip 88 which extends transversely to the top edge of panel 84. The ends of each lip 86, 88 projects outward from the corners of the respective panel 82, 84. Thus lip 86 has terminal extensions or projections 90, 92 and lip 88 has terminal extensions or projections or projections 94, 96. As will appear infra, when the toy house is assembled, each terminal extension 90, 92, 94 or 96 extends into one of the upper recesses 70, 76 of a respective vertical strip 66, 68. The outer corners 98, 100 of panel 82 and the outer corners 102, 104 of panel 84 are preferably curved, i.e. rounded as shown, to provide a pleasing effect and to prevent injury to children playing with the toy house.

The toy house is completed in its broadest and most general embodiment by the provision of a fifth panel 106 which is a generally rectangular horizontal floor panel. The panel 106 is characterized by the provision of slots 108, 110, 112 and 114. Each of these slots extends inwards from an edge of the periphery of the panel 106, so that each terminal vertically downward extension of the lower edges of the panels 30 and 56 fits into one of the slots when the toy house is assembled, to provide structural rigidity to the toy house. Thus, extension 52 fits into slot 108, extension 54 fits into slot 112, extension 62 fits into slot 114 and extension 64 fits into slot 110, when the toy house is assembled.

Various preferred embodiments and appurtenances of the toy house are shown and will be described. At the onset, it is preferred for reasons of symmetry and stability that the vertical slots 32 and 58 be centrally located in the respective panels 30 and 56, and that the slots 108, 110, 112 and 114 are each located at about the center of the respective side edge of the rectangular floor panel 106. These configurations of the slots lead to a symmetrical toy house, which is desired for reasons of appearance, strength and stability.

In addition, two optional appurtenances for the toy house are shown in FIG. 1, namely a chimney 116 and a horizontal patio member 118. The chimney 116 is of rectangular parallelepiped configuration. The lower edge of a front panel 120 of the chimney 116 is of a specific configuration to accommodate emplacement of the chimney anywhere along the peak of the toy house as desired. Thus, the front panel 120 of chimney 116 has a lower edge having two portions 122, 124 which slope upwards from the ends, i.e. corners, of the chimney to a central notch 126. The opposed lower edge of the opposite back panel 128 of chimney 116 is of a similar configuration, so that the notches such as 126 fit over the juxtaposed lips 86, 88 of the respective roof panels 82, 84 when the toy house is assembled, and also the sloping edge portions 122, 124 fit nicely onto the respective roof panel surfaces 82, 84, which panel surfaces in turn are sloped because of the slope in edges 34, 36.

The patio panel 118 is an optional additional sixth panel in the toy house combination. The panel 118 is a generally rectangular horizontal patio panel, with a notch 130 being provided in one edge of the panel, which notch 130 fits over the lower end of the strip 68 when the toy house is assembled. It is evident that the patio panel 118 may be disposed adjacent to any side of the toy house, thus notch 130 could alternatively accommodate for the lower end of strips 66, 38 or 40.

As was the case with corners 98, 100, 102 and 104, it is evident that corners 132, 134, 136 and 138 of panel 106 and corners 140 and 142 of panel 118 are preferably curved, i.e. rounded. In addition, it is apparent that more than one chimney 116 and/or more than one patio panel 118 may be provided in practice.

FIGS. 2, 3, 4 and 5 illustrate the fully assembled toy house. The coaction between the panels and appurtenances thereto is as described supra, thus the vertical panels 30 and 56 are at right angles with the central vertical slot in each panel accommodating the other panel. The lower vertically downward extensions 52, 54 in panel 30 and 62, 64 in panel 56 each fit into one of the slots in horizontal floor panel 106. FIG. 5 illustrates this arrangement in detail, as well as the fitting of the patio panel 118 into the assemblage. Miniature or toy articles of furniture are shown in phantom outline in FIGS. 2, 3 and 4, with each quarter section of the toy house serving as a simulation of a different room of the house, e.g. living room, kitchen, bedroom.

Figure 7:
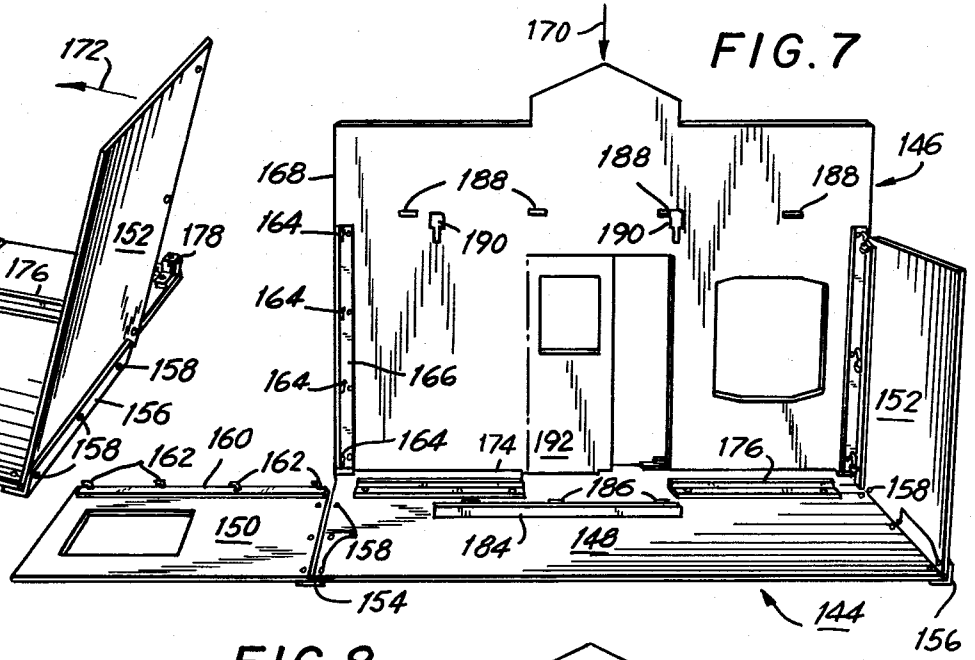
FIG. 7 shows the coaction and assembly steps of two panels of the alternative embodiment.
Figure 8:
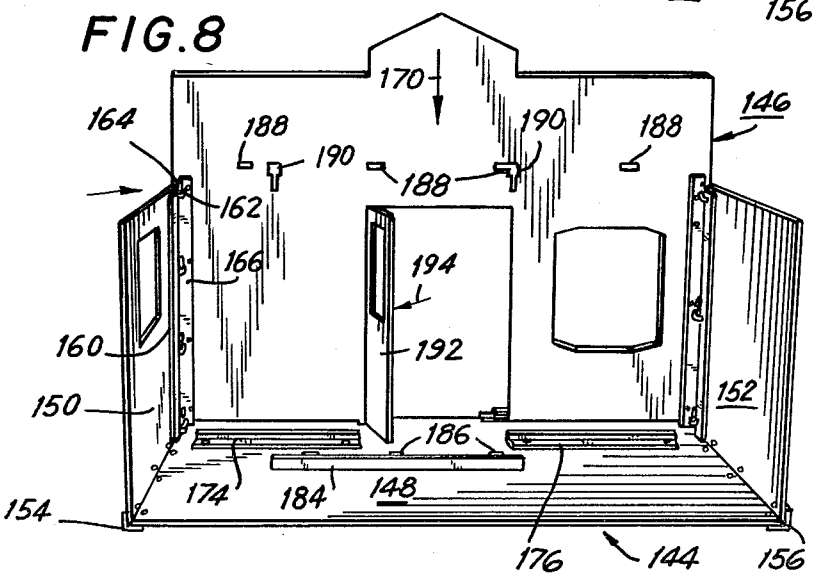
FIGS. 8, 9 and 10 show further assembly steps of the alternative embodiment of the invention.
Figure 6:
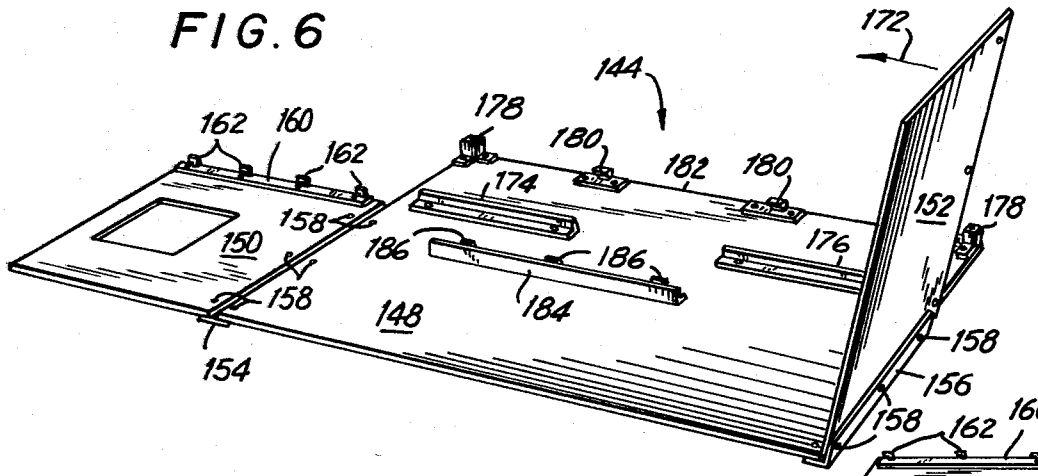
FIG. 6 is a perspective view of a panel member of an alternative embodiment of the invention.

Referring now to FIGS. 6, 7 and 8, one panel member 144 of an alternative embodiment of the invention is shown. The panel 144 for purposes of reference will be referred to as the second panel of the combination, with the first panel being shown in FIG. 7 as a vertically oriented interior panel 146. The panel 144, which is the second panel in the combination, is horizontally oriented for assembly and includes a central floor section 148 and lateral sections 150 and 152. Each lateral section 150, 152 is connected along one edge to the central floor section 148 by a bendable, i.e. flexible and resilient, connection, so that the lateral sections, note section 152 in FIG. 6, are capable of being elevated to form upright wall sections perpendicular to the central floor section 148. The bendable connections 154 between sections 148 and 150, and 156 between sections 148 and 152, consist generally of strips of any suitable flexible and resilient material, e.g. a plastic such as polyethylene, polypropylene, especially isotactic polypropylene, or polyvinyl chloride, natural or synthetic rubber, etc.

Bendable connections 154 and 156 are attached to the respective members 148 and 150 or 152 by means of suitable rivets, bolts, or staples, generally designated as 158. The attachments 158 are permanent attachments, and in order to allow the connections 154 and 156 to bend, a longitudinal groove may be provided in each of these members. The panels 144 and 146 may be composed of any suitable material e.g. a plastic similar to that used for the strips 154 and 156, however the panels 144 and 146 are preferably composed of laminated cardboard, with the outer surfaces of the panels as well as the joining pieces being composed of plastic. Thus basically the panels 144 and 146 in most instances will be laminated cardboard panels which essentially consist of flat pieces of laminated paper, with each panel being printed with legends and/or pictures, and with each panel being covered on both sides with a plastic film. This plastic film consists generally of transparent plastic material such as polyethylene, polyvinyl chloride, mylar, cellulose acetate, cellulose acetate butyrate, nylon, or acrylic resin such as methyl methacrylate or lucite.

Figure 9:
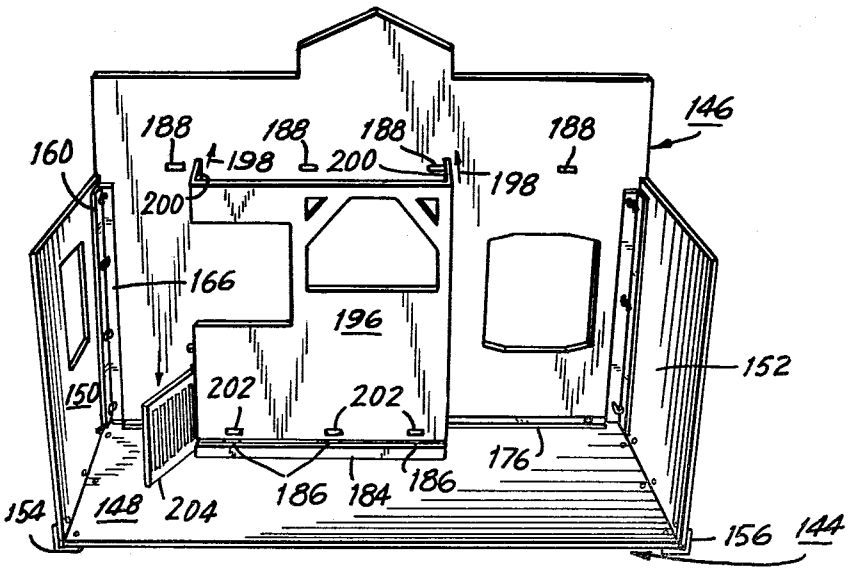

As best shown in FIG. 6, panel member 150, which when assembled into the toy house will be an upright wall section perpendicular to the central floor section 148, is provided with a plastic stiffening rib 160 along one edge, which rib 160 will be vertically oriented when the toy house is assembled. The rib 160 is provided with a plurality of spaced apart L-shaped protrusions 162, which as will appear infra, are slidable into locked position with corresponding spaced apart L-shaped protrusions along a vertical edge of the panel 146. This cooperation between L-shaped protrusions is best shown in FIGS. 7, 8 and 9. In these figures the interlocking between protrusions 162 and a corresponding plurality of protrusions 164 on rib 166 disposed along a vertical edge 168 of panel 146 is evident. To attain this cooperation, the outer arm of each protrusion 162 extends upwards, while the outer arm of each protrusion 164 extends downwards, so that the protrusions 162 and 164 are slidable together into lock position. A similar connection means is provided between the upright wall section 152 of panel 144, and panel 146. Referring to FIG. 7, the arrow 170 shows the direction of manual manipulation of panel 146 vertically downwards to accomplish the emplacement of panel 146 in conjunction with the maintenance of panels 150 and 152 in an upright position, which is also manually accomplished as shown by arrow 172 (FIG. 6). Stop members 174 and 176 are provided in order to maintain panel 146 in position.

Figure 10:
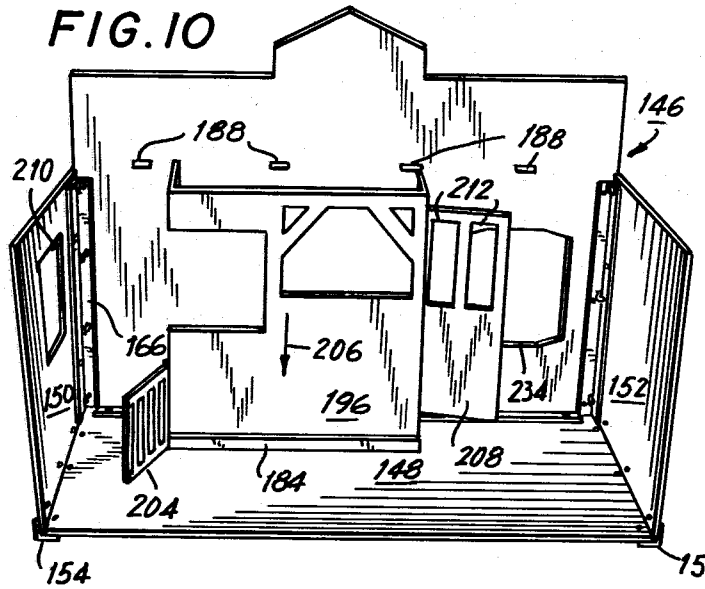

FIG. 6 also shows other elements which are provided for the coupling of members of the toy house to panel 144. Thus FIG. 6 shows recesses 178 at adjacent corners of the central floor section 148 of the second panel 144, as well as raised flat horizontal ribs 180 along edge 182 of section 148. The members 178, 180 are mounted to section 148 by an appropriate means comparable to ribs 160 and 166 together with fastening means such as elements 158 described supra. Finally, FIG. 6 shows a mounting element 184 which is provided with a plurality of clip members 186, so that an appurtenance of the toy house may be clipped into place. Referring now to FIG. 7, the panel 146 is provided with a plurality of spaced apart horizontal slots 188, as well as two openings 190 having a wide upper portion and a narrower lower portion. Referring now to FIGS. 7 and 8, a simulated door 192 is provided, and this door 192 opens inwards as shown by the arrow 194 (FIG. 8). Referring now to FIG. 9 and 10, the emplacement of a partition member 196 which simulates an interior partition in a country store is shown. FIG. 9 shows (note arrows 198) how the member 196 is disposed for emplacement. The terminal vertical edges 200 of member 196 are each provided with a protruding rib, and the ribs are inserted through the wide portion of the respective opening 190; thereafter the member 196 is moved downwards so that the rib in each case slidingly engages the narrow lower portion of the opening 190. Concomitantly, the lower slots 202 of member 196 engage members 186, as will appear infra. FIG. 9 also shows the emplacement of a gate 204 along one side edge of partition member 196.

Figure 11:
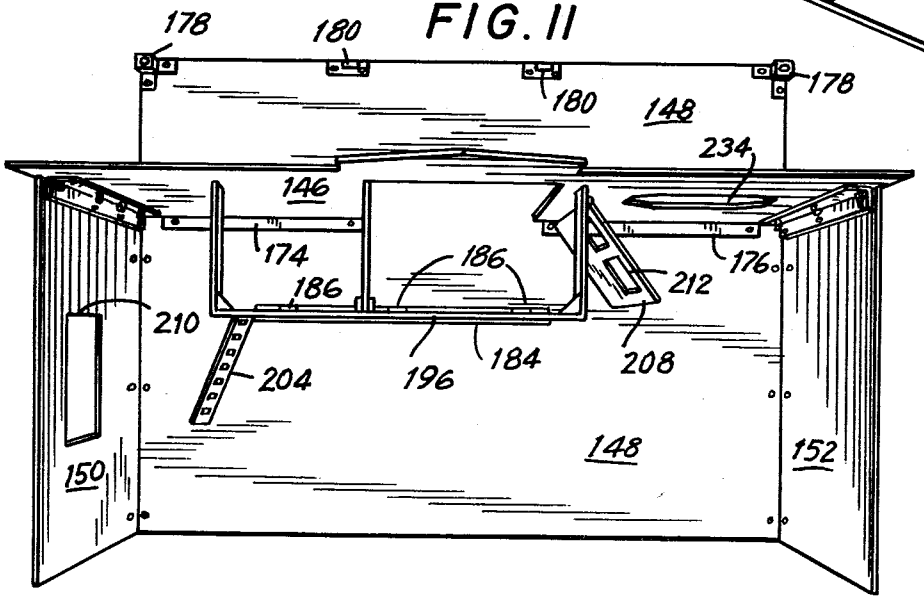
FIG. 11 is a perspective plan view of the partially erected alternative embodiment.

FIG. 10 shows the fully assembled simulated interior of the toy house, which in this case is a toy store e.g. a toy country store as will appear infra. The final stage in the assembly is indicated by arrow 206 in which member 196 is moved downwards into position with its lower edge held by member 184. In addition a simulated door 208 has been emplaced on the side of member 196. Appropriate spacings or openings are provided to simulate a real store, such as window opening 210 in panel member 150 and openings 212 in door member 208. FIG. 11 illustrates how the front of the toy house, which is provided with members 178 and 180, extends outwards as a porch from the front of panel 146. Thus in FIG. 11, the lower porch of central floor section 148 provides the floor of the interior of the toy house while the upright wall sections 150 and 152 provide the walls of the toy house.

Figure 12:
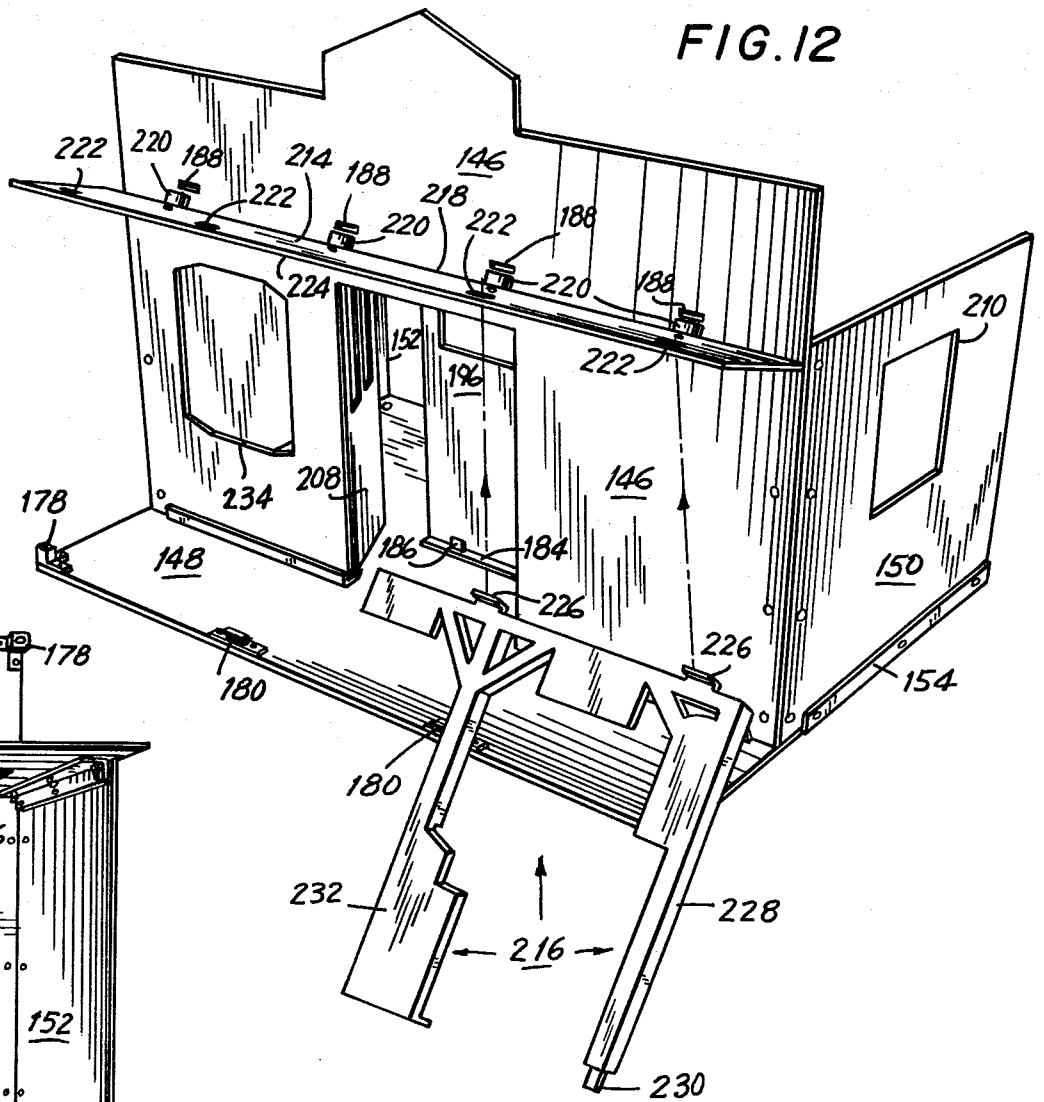
FIGS. 12 and 13 show emplacement of the roof panel and stanchions in the alternative embodiment.

FIG. 12 illustrates the initial stages of assembly of the front porch of the toy country store. The principal members of the front porch assembly are a third i.e. roof, panel 214, and a bifurcated stanchion 216, which in this embodiment of the invention is one of two mirror-image stanchions. It will be apparent that the provision of a bifurcated stanchion of the specific configuration of stanchion 216 is a preferred embodiment of the invention, and that other suitable stanchion configurations may be adopted in practice.

Figure 13:
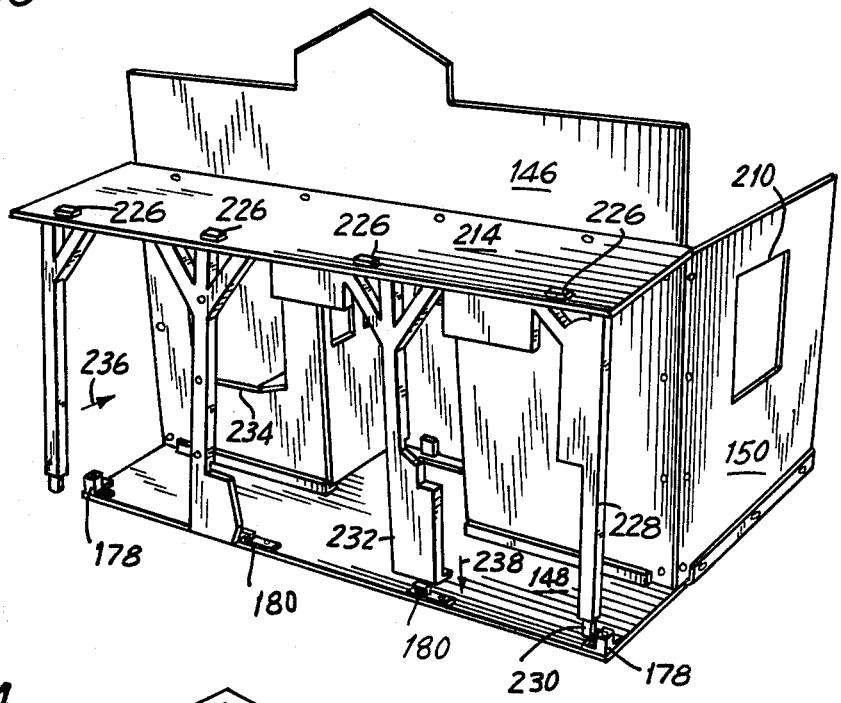

Referring first to the roof panel 214, this third main panel of the toy house is mounted along an edge 218 to the first panel 146 by providing a plurality of spaced apart L-shaped tabs 220 along the edge of the third panel. The L shape of the tabs 220 is primarily for reasons of structural integrity, and it will be understood that other suitable tab shapes may be provided in practice. It therefore will be understood that the term "L-Shaped" refers primarily to the fact that the tab end is generally perpendicular to the surface of panel 214. A plurality of tab entry openings described supra as openings 188 are provided in the first panel 146, so that the rear edge 218 of panel 214 may readily be emplaced by disposing panel 214 at an acute angle relative to panel 146 as shown in FIG. 12 and inserting each tab 220 into the respective slot opening 188. The panel 214 is also provided with a plurality of slots 222 along the edge 224 opposite to edge 218. These slots 222 accommodate the upper L-shaped tabs 226 in the stanchion 216, so that the tabs 226 fit into and through openings 222 in a manner similar to the insertion of tabs 220 described supra. The major salient difference between the disposition of the tabs is that when the toy country store is fully assembled the ends of the tabs 226 will lie horizontally on top of panel 214, whereas in the case of tab 220, the ends of these tabs will be vertically adjacent to the rear surface of panel 146. One leg 228 of the stanchion 216 is provided with the lower protuberance 230, which as will appear infra fits into a recess 178. The other leg 232 of stanchion 216 has a lower opening to accommodate rib 180, as will appear infra. The panel 146 is also provided with a window 234 to simulate the front of a store. FIG. 13 shows the final stages of assembly of the front porch of the toy house i.e. the toy country store. In this case, the tabs 226 have been inserted into openings 222 in panel 214, and the stanchions are moving rearwards as shown by arrow 236 and downwards as shown by arrow 238, to emplace the lower ends of the stanchions in the fittings 178 and 180 provided in panel 148.

Figure 14:
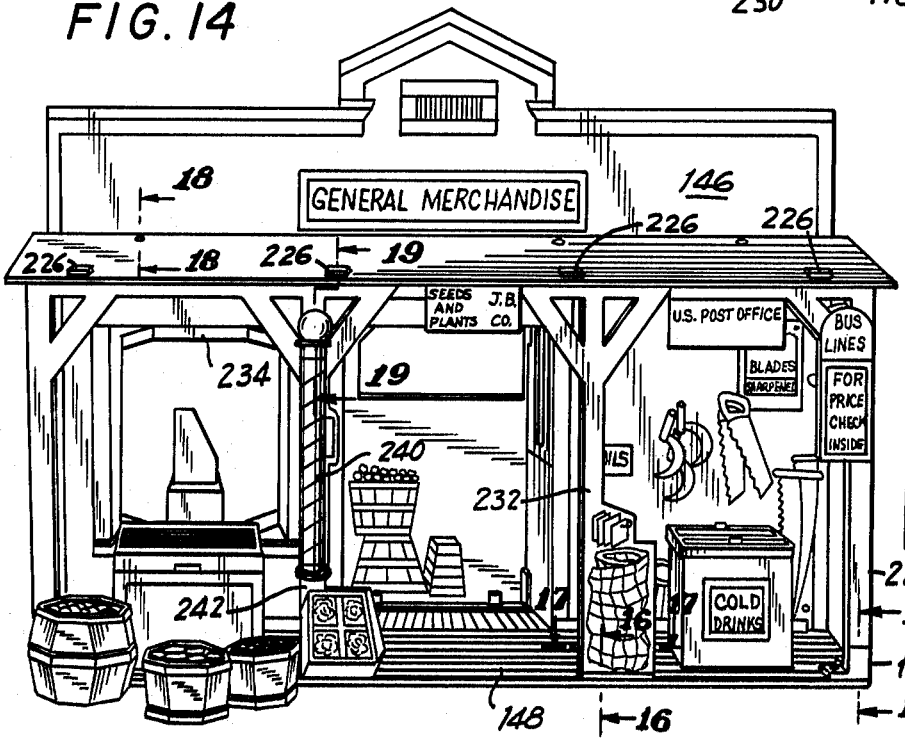
FIG. 14 shows the completed front of the toy house, in this case having the appurtenances of a toy country store.
Figure 15:
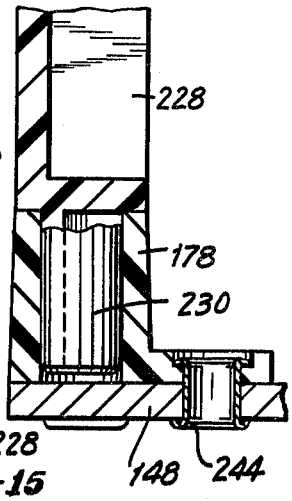
FIGS. 15 and 16 are partial sectional elevation views taken substantially along the lines 15—15 and 16—16 of FIG. 14 and showing stanchion joints.
Figure 16:
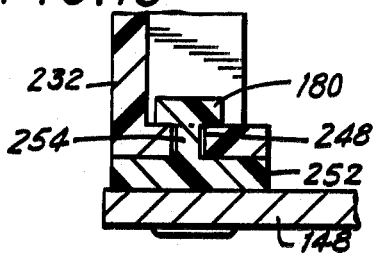
Figure 17:
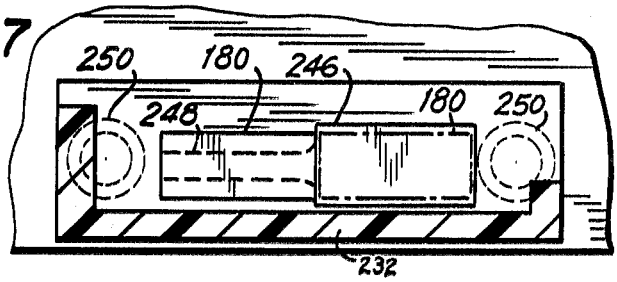
FIG. 17 is a partial sectional plan view taken substantially along the line 17—17 of FIG. 14 and showing a stanchion joint.

FIG. 14 shows a fully assembled front porch of the toy country store, including various ancillary items which are provided to enhance the illusion of a real country store. In addition suitable labels have been affixed to various items so that they are identified and readily related to by a child. Thus for example, a simulated barber pole 240 has been mounted on a leg 242 of the second bifurcated stanchion. FIGS. 15, 16, 17, 18, and 19 show sectional views illustrating details of the assembly joints. Thus FIG. 15 shows the protuberance 230 extending into a recess member 178. In addition, a typical metallic rivet 244 used for permanent attachment of member 178, which is composed of a plastic, to panel 148, which is composed of cardboard, is shown. FIGS. 16 and 17 show details of the joint between stanchion leg 232 and panel 148. Thus rib 180 has been inserted upwards through the wider section 246 of an opening in the base of leg 232, thereafter leg 232 has been moved laterally from its initial position in which rib 180 is shown in phantom outline, to its final position in which rib 180 extends above narrow slot section 248 of the lower opening in the base of leg 232. Attachment rivets 250, which are similar in configuration and function to rivet 244 described supra are also shown in phantom outline. These rivets 250 serve to hold the lower base portion 252 of rib 180 in position, with rib 180 being joined to base 252 by the narrow neck 254.

Figure 18:
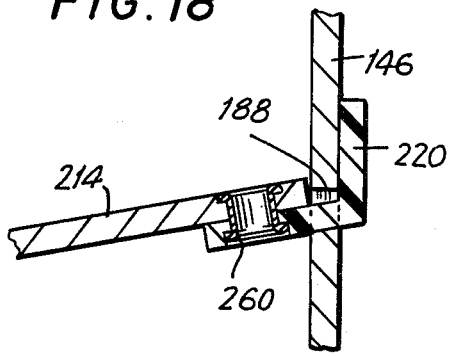
FIGS. 18 and 19 are partial sectional elevation views taken substantially along the lines 18—18 and 19—19 of FIG. 14 and showing further details of joints.

FIG. 18 shows the disposition of tab 220 in a slot 188, as well as another rivet 260 which is similar in configuration and function to rivet 244 described supra in that rivet 260 attaches the L-shaped plastic tab 220 to the cardboard panel 214.

Figure 19:
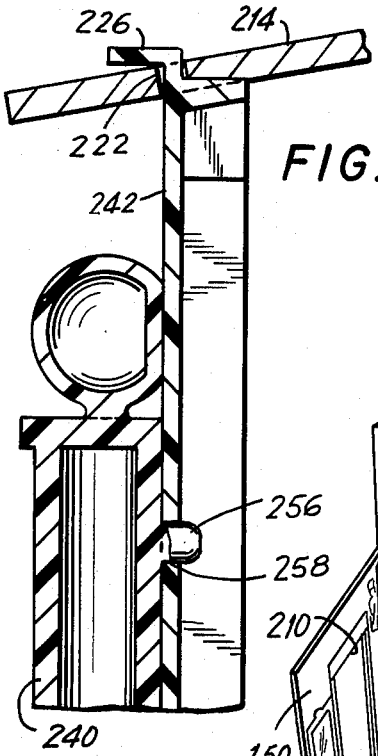

FIG. 19 shows how tab 226 is disposed in the opening of slot 222. FIG. 19 also shows how the simulated barber pole 240 is mounted along stanchion leg 242 by horizontal protuberance 256 which extends through a hole 258 in stanchion leg 242.

Figure 20:
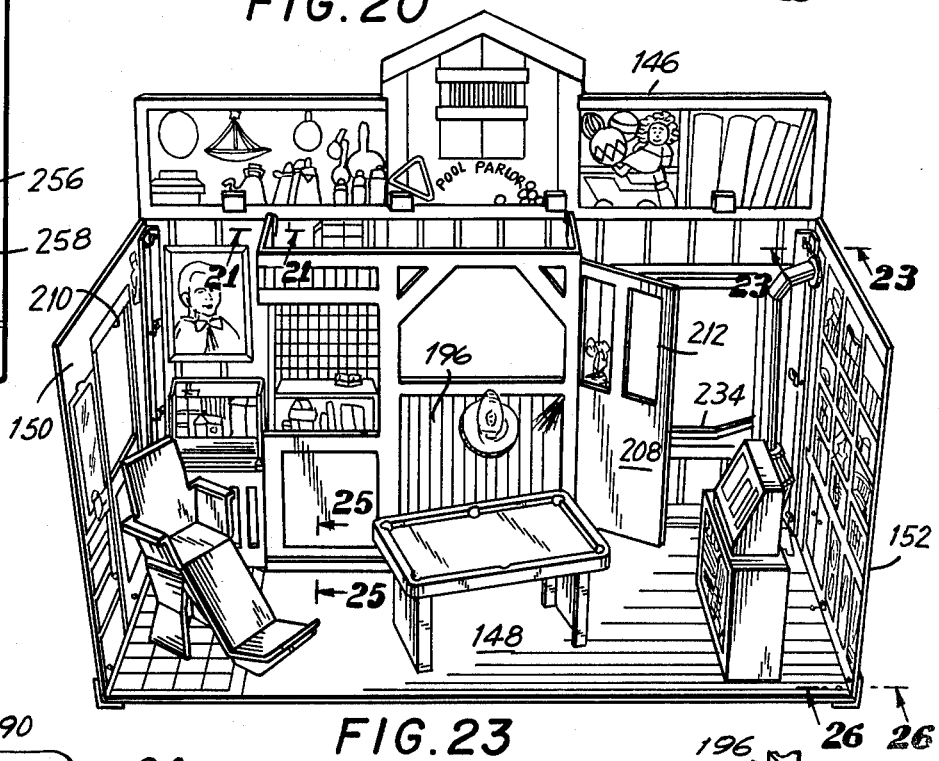
FIG. 20 is a perspective view of the rear or interior of the country store of FIG. 14.
Figure 21:
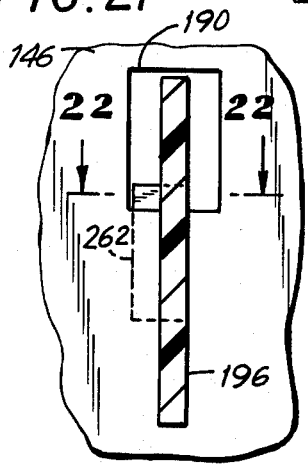
FIG. 21 is a sectional elevation view of a joint taken substantially along the line 21—21 of FIG. 20.
Figure 23:
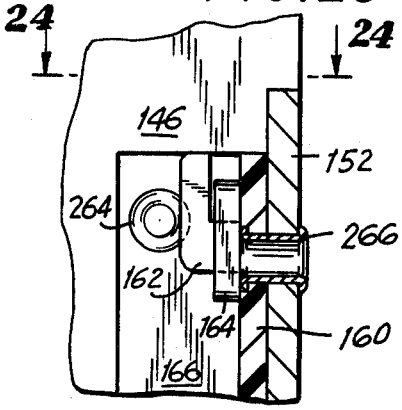
FIG. 23 is a sectional elevation view of another joint, taken substantially along the line 23—23 of FIG. 20.
Figure 25:
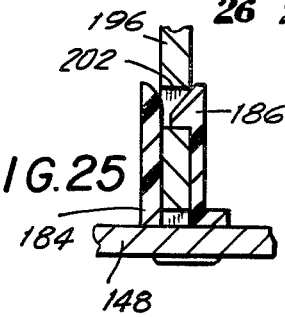
FIGS. 25 and 26 are sectional elevation views of still further joints in FIG. 20, taken substantially along the lines 25—25 and 26—26 of FIG. 20.
Figure 22:
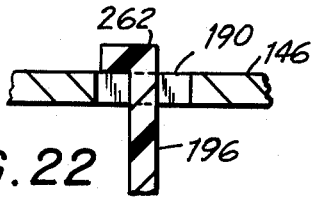
FIG. 22 is a sectional plan view of the joint of FIG. 21, taken substantially along the line 22—22.
Figure 24:
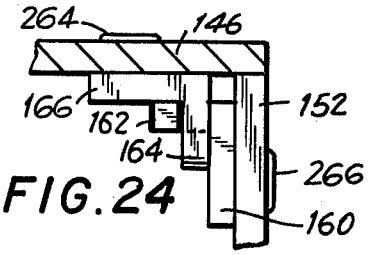
FIG. 24 is a sectional plan view of the joint of FIG. 23, taken substantially along the line 24—24.
Figure 26:
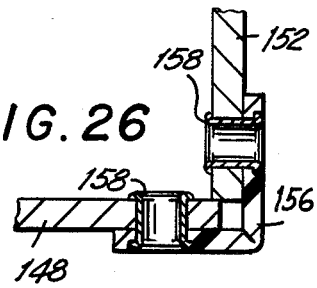

FIG. 20 shows the interior of the toy house consisting in this case of a simulated toy country store. Labels have been affixed to the panels and small plastic simulated items of furnishings are shown within the interior of the toy country store. FIGS. 21 and 22 show the joint between member 196 and panel 146 including a lip 262 which extends laterally from the edge of the side panel of member 196. FIGS. 23 and 24 show a typical joint between the upright side wall section 152 which consists of a lateral section of panel 148 which has been converted into an upright vertical wall section as described supra; and the panel 146. This joint is essentially between L-shaped or hook-shaped elements 162 and 164, which interlock is shown. Rivets 264 and 266 which join the plastic mountings 166 and 160 to the respective cardboard panels 146 and 152 are also shown. FIG. 25 shows details of the joint between the base of member 196 and floor panel 148. The retention in this case is attained by the lip of element 186 extending to slot 202. FIG. 26 shows in detail the configuration of the bendable, i.e. flexible and resilient, connection 156 between members 148 and 152 in the fully assembled toy house, including rivets 158.

It thus will be seen that there is provided a toy house which achieves the various objects of the invention and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense.

Having thus described the invention, there is claimed as new and desired to be secured by Letters Patent:

1. A toy house assembled from a plurality of panels and comprising a plurality of flat planar panels, said panels including (a) a first panel, said first panel being a vertically oriented interior panel having an upper vertical slot, two upper edges which slope downwardly away from the open upper end of said upper slot, two vertical side edges, each of said side edges being defined by a vertical strip, each vertical strip having two lips which extend transversely to a side edge of said first panel, and a lower horizontal edge having a terminal vertical extension at each end thereof;

(b) a second panel, said second panel being a generally rectangular vertically oriented interior panel having a lower vertical slot, said lower slot extending upwards from the lower horizontal edge of said second panel, so that when the toy house is assembled, said first and second panels are substantially perpendicular to each other with each of said first and second panels fitting into the respective slot of the other panel, the lower horizontal edge of said second panel having a terminal vertical extension at each end thereof, and two vertical side edges, each of said side edges being defined by a vertical strip, each vertical strip having an upper recess and two lips which extend transversely to a side edge of said second panel;

(c) a third and fourth panels, said third and fourth panels being generally rectangular roof panels, each of said third and fourth panels having a horizontal lip which extends transversely to the top edge of the respective associated panel, each lip projecting outwards from a corner of said associated panel so that each lip extends into one of said upper recesses in a vertical strip of a said second panel when the toy house is assembled; and (d) a fifth panel, said fifth panel being a generally rectangular horizontal floor panel, each edge of said fifth panel having a slot which extends inwards from the periphery of said fifth panel, so that each terminal vertical extension of said first and second panels extends into a slot when the toy house is assembled.

2. The toy house of claim 1 together with a rectangular parallelepiped chimney, each of two opposed lower edges of said chimney sloping upwards from either end to a central notch, said notches fitting over the juxtaposed lips of the third and fourth panels when the toy house is assembled.

3. The toy house of claim 1 in which the outer corners of the third and fourth panels and the corners of the fifth panel are rounded.

4. The toy house of claim 1 in which the panels are composed of wood.

5. The toy house of claim 4 in which the wood panels are plywood.

6. The toy house of claim 1 together with a sixth panel, said sixth panel being a generally rectangular horizontal patio panel, one edge of said sixth panel having a notch, said notch fitting over the lower end of a strip of the first or second panel when the toy house is assembled.

7. The toy house of claim 6 in which the outer corners of the sixth panel are rounded.

8. The toy house of claim 1 in which the upper vertical slot of the first panel and the lower vertical slot of the second panel are each centrally located in the respective panel, and the slots in the fifth panel are each located about at the center of the respective side edge of the fifth panel.

* * * * *